US008641239B2

(12) United States Patent
Yurich

(10) Patent No.: US 8,641,239 B2
(45) **Date of Patent: *Feb. 4, 2014**

(54) REFLECTOR FOR A LIGHTING ASSEMBLY

(75) Inventor: Gary D. Yurich, Royal Oak, MI (US)

(73) Assignee: Best Lights, Inc., Troy, MI (US)

( * ) Notice: Subject to any disclaimer, the term of this patent is extended or adjusted under 35 U.S.C. 154(b) by 964 days.

This patent is subject to a terminal disclaimer.

(21) Appl. No.: 12/684,524

(22) Filed: Jan. 8, 2010

(65) Prior Publication Data

US 2011/0169412 A1 Jul. 14, 2011

(51) Int. Cl.
*F21V 7/00* (2006.01)

(52) U.S. Cl.
USPC ..... 362/346; 362/296.01; 362/297; 362/301; 362/302; 362/341; 362/514; 362/516; 362/517; 313/113; 313/114; 313/318.11; 359/726; 359/727; 359/627; 359/628

(58) Field of Classification Search
USPC ..... 362/296.01, 297, 301, 302, 341, 342, 362/346, 349, 350, 514, 516, 517; 313/113, 313/114, 318.11; 359/726, 727, 627, 628
See application file for complete search history.

(56) References Cited

U.S. PATENT DOCUMENTS

| | | | | | |
|---|---|---|---|---|---|
| 1,186,165 | A | * | 6/1916 | Benjamin | 362/349 |
| 2,004,443 | A | * | 6/1935 | Kovac | 359/528 |
| 3,329,812 | A | * | 7/1967 | Harling | 362/223 |
| 3,662,165 | A | | 5/1972 | Osteen et al. | |
| 3,900,727 | A | * | 8/1975 | Hutz | 362/263 |
| 4,363,086 | A | | 12/1982 | Fletcher | |
| 4,403,277 | A | | 9/1983 | Eargle, Jr. et al. | |
| 4,453,203 | A | | 6/1984 | Pate | |
| 4,864,476 | A | | 9/1989 | Lemons et al. | |
| 5,287,259 | A | | 2/1994 | Lautzenheiser | |
| 5,355,290 | A | * | 10/1994 | Tickner | 362/294 |
| 5,895,114 | A | * | 4/1999 | Thornton | 362/306 |
| 5,924,789 | A | * | 7/1999 | Thornton | 362/370 |
| 5,927,843 | A | | 7/1999 | Haugaard et al. | |
| 5,975,723 | A | * | 11/1999 | Daumueller et al. | 362/297 |
| 6,024,469 | A | * | 2/2000 | Greif | 362/346 |
| 6,036,338 | A | | 3/2000 | Gordin | |
| D431,316 | S | | 9/2000 | Tickner | |

(Continued)

OTHER PUBLICATIONS

Indoor Courts of America, Elite Lighting System, http://www.icasbs.com/images/Elite%20Lighting%20Spec%20Sheet.pdf (Retrieved on or about Jan. 28, 2009).

(Continued)

*Primary Examiner* — Mary McManmon
(74) *Attorney, Agent, or Firm* — Howard & Howard Attorneys PLLC

(57) ABSTRACT

A lighting assembly utilizing a reflective body for use with a light source to uniformly disperse the light from the light source. The reflective body includes a lower array of first reflectors arranged about a central axis. Each of the first reflectors form an obtuse angle with the next adjacent first reflector. The reflective body also includes an upper array of second reflectors arranged about the central axis. Each of said second reflectors include a left face and a right face. The upper array defines obtuse angles between next adjacent second reflectors. Additionally, reflex angles are defined between the left and right faces of the second reflectors. The combination of angles evenly disperse the light supplied from the light source to provide a pleasant glow for illuminating an area below the lighting assembly without causing hot spots.

14 Claims, 10 Drawing Sheets

(56) References Cited

U.S. PATENT DOCUMENTS

| | | | | |
|---|---|---|---|---|
| 6,382,803 | B1 * | 5/2002 | Arumugasaamy | 359/850 |
| 6,390,649 | B1 * | 5/2002 | Tang | 362/285 |
| 6,464,378 | B1 | 10/2002 | Reed et al. | |
| 6,595,662 | B2 | 7/2003 | Wardenburg | |
| 6,601,975 | B1 | 8/2003 | Haugaard et al. | |
| 6,703,799 | B2 | 3/2004 | Summerford et al. | |
| 6,837,900 | B2 | 1/2005 | Ullrich et al. | |
| 7,025,476 | B2 * | 4/2006 | Leadford | 362/309 |
| 7,244,050 | B2 * | 7/2007 | Summerford et al. | 362/327 |
| 7,350,940 | B2 | 4/2008 | Haugaard et al. | |
| 7,445,362 | B2 * | 11/2008 | Compton et al. | 362/346 |
| 7,445,363 | B2 | 11/2008 | Vanden Eynden | |
| 2003/0035299 | A1 * | 2/2003 | Amano | 362/545 |
| 2007/0070633 | A1 * | 3/2007 | Eynden | 362/346 |
| 2008/0137347 | A1 * | 6/2008 | Trott et al. | 362/311 |
| 2010/0214789 | A1 * | 8/2010 | Hawkes et al. | 362/346 |

OTHER PUBLICATIONS

Sports Interiors, Inc., Metal Halide SUN Series, Indirect Vertical Lamp Pendant, http://www/silighting.com/fixture.htm (Retrieved on or about Jan. 28, 2009).

* cited by examiner

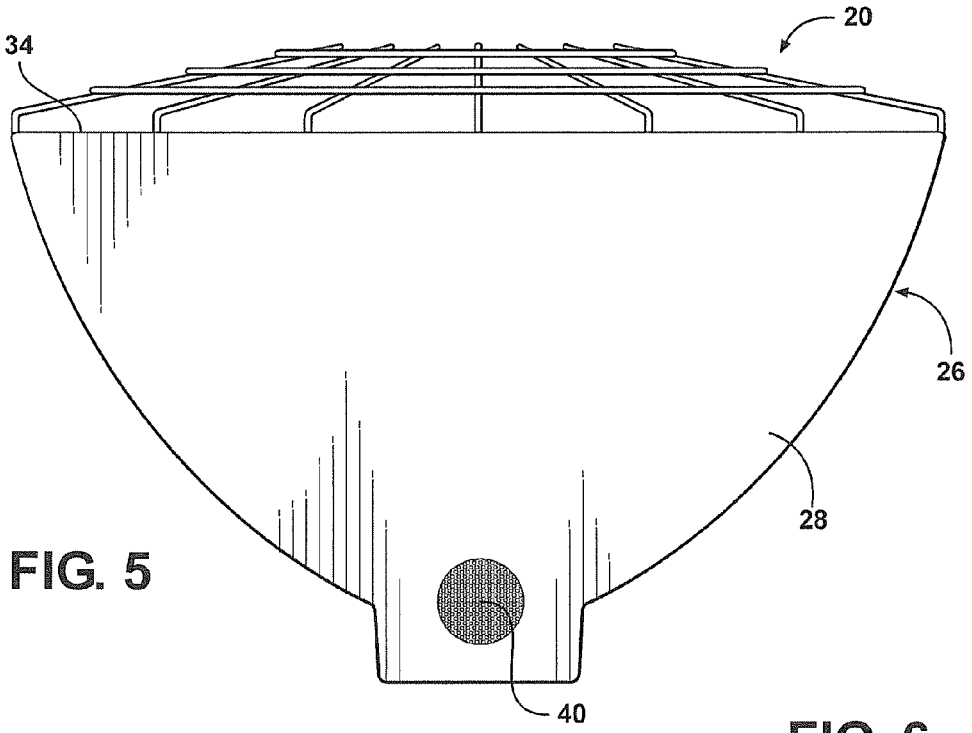
FIG. 5
FIG. 6
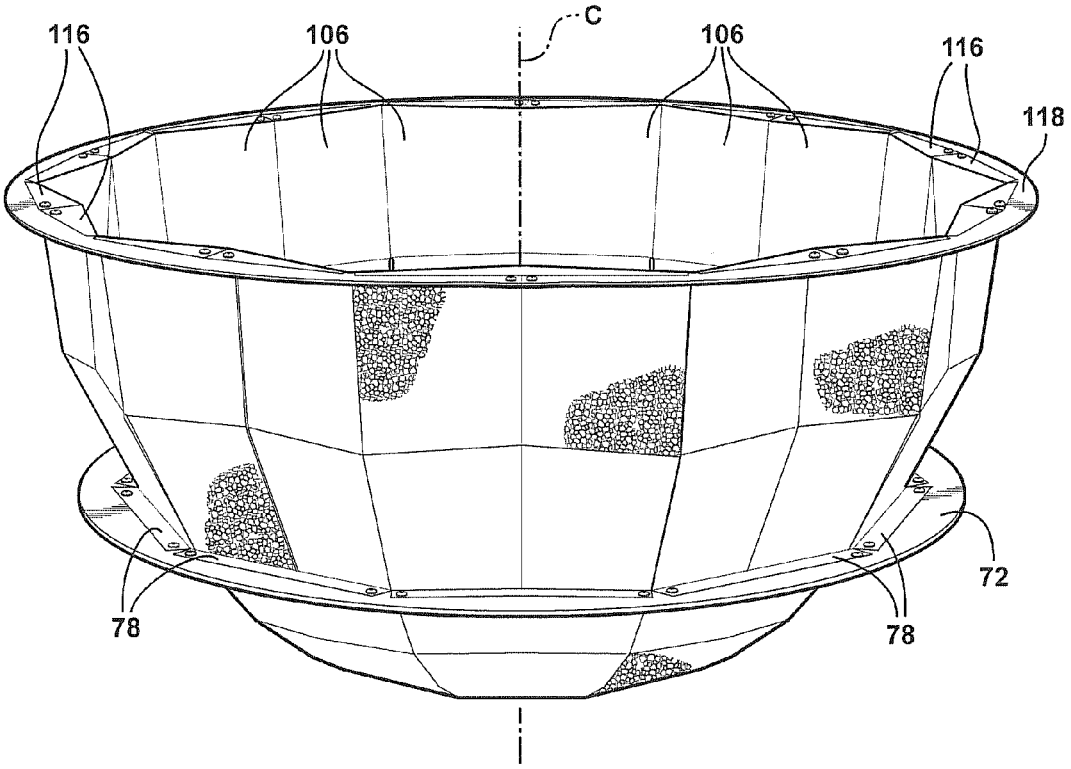

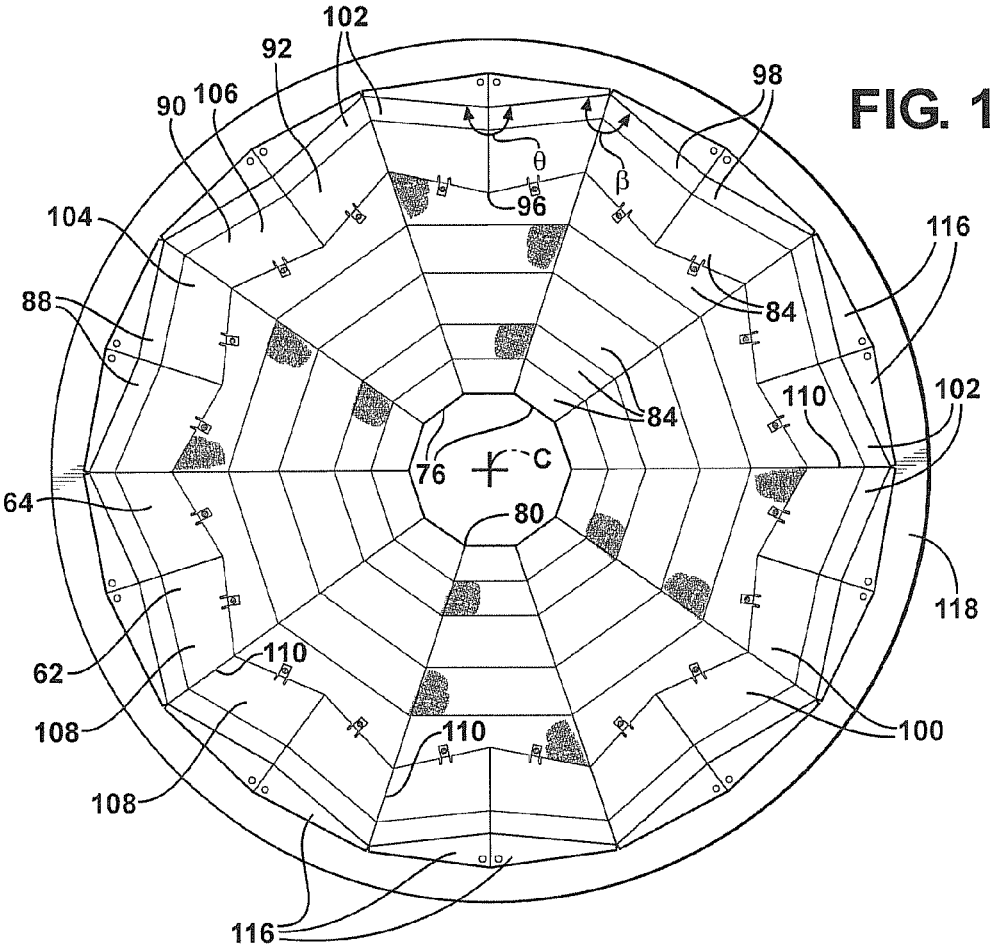
FIG. 12
FIG. 13
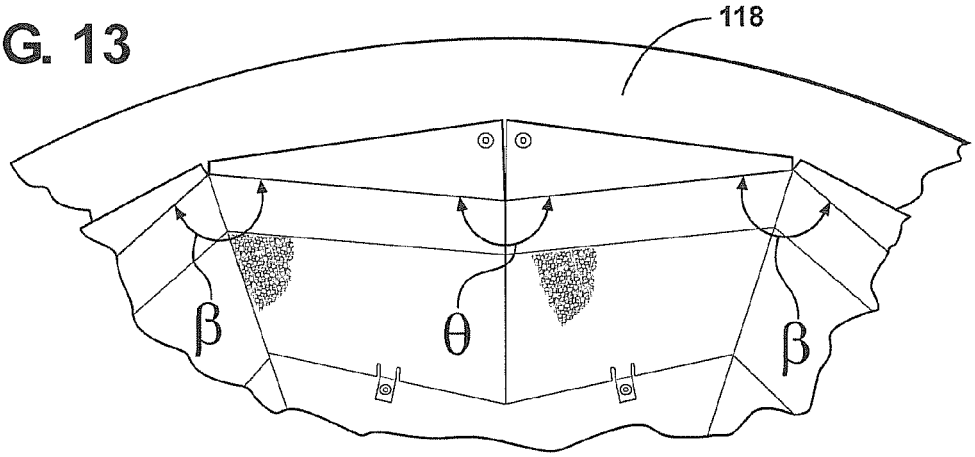

REFLECTOR FOR A LIGHTING ASSEMBLY

FIELD OF THE INVENTION

The present invention generally relates to an indirect lighting assembly, and more specifically, to a reflective body for dispersing light out of the lighting assembly and to a surface above the lighting assembly and reflected to an area below the lighting assembly to produce uniform indirect illumination to the area below.

BACKGROUND

Various lighting assemblies utilizing reflectors are well known in the prior art. Many on the lighting assemblies of the prior art include reflectors in an attempt to optimize the amount of light output. One such assembly, used for industrial lighting, utilizes a dome-shaped reflector formed of vertically oriented faces arranged around an axis. Each of the faces extend from the top to the bottom of the dome and are symmetrically arranged side-by-side for defining a plurality of vertically oriented ridges and grooves to provide overlapping areas of light to the area below the light assembly. Additionally, each of the faces have a convex configuration with respect to the lamp.

Another prior art patent, for use with outdoor field lighting discloses a reflector having a dome-shaped base structure with a plurality of reflective panels flexed to conform to the dome-shaped of the base structure and fastened therein, about a lamp. Each of the sections defines a face having a surface treatment, such as a hammer-toned finish or a corrugated finish.

Other prior art patents disclose lighting assemblies having a housing including a reflector disposed therein. An electrical system, including a ballast for regulating electricity, is coupled to the housing or is mounted to an area near the lighting system. These types of assemblies require extensive wiring to be done by a professional such as an electrician to properly connect the ballast to the electricity source and to the lighting assembly. Typically there are multiple lights required to light the area, therefore installation can be very time consuming and the associated costs can be substantial.

These patents fail to disclose a housing that is configured to accept all of the electrical components within the housing. As stated above, the lighting assemblies disclosed in the prior art typically require an electrician or other type of specialized technician to properly install and wire these assemblies which can prove to be difficult near the ceiling, so far off the ground. Typically, lighting assemblies are less than 90% efficient, i.e. the assemblies emit less than 90% of the light output from the light source.

Although the prior art lighting assemblies attempt to improve efficiency of light output and extend the life of the lighting source within the assembly, there remains a need for a lighting assembly that is relatively simple to install and that efficiently disperses uniform lighting output.

SUMMARY OF THE INVENTION

The present invention provides a lighting assembly utilizing a reflective body for use with a light source to disperse light from the light source. The reflective body includes a lower array of first reflectors arranged about a central axis. Each of the first reflectors form an obtuse angle with the next adjacent first reflector. The reflective body also includes an upper array of second reflectors arranged about the central axis. Each of said second reflectors include a left face and a right face. The upper array defines obtuse angles between next adjacent second reflectors. Additionally, reflex angles are defined between the left and right faces of the second reflectors. The combination of angles evenly disperse the light supplied from the light source to provide a improved glow. The lighting assembly of the present invention also provides for ease of installation, since typical facilities require numerous assemblies. Additionally, the lighting assemblies of the present invention do not require any specialized wiring to be done by the end user, i.e. saving the cost of an electrician or a specialized technician. The lighting assembly of the present invention need only be plugged into a standard electrical outlet. Further the lighting assembly of the present invention emits light more efficiently than the lighting assemblies currently known in the art.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 5 is an end view of the lighting assembly.

FIG. 6 is a perspective view of a reflective body of the lighting assembly.

FIG. 12 is a top view of the reflective body.

FIG. 13 is a fragmented enlarged top view of the reflective body.

DETAILED DESCRIPTION OF THE INVENTION

Referring to the Figures wherein like numerals indicate like or corresponding parts throughout the several views, a lighting assembly is generally shown at 20.

Figure 1:
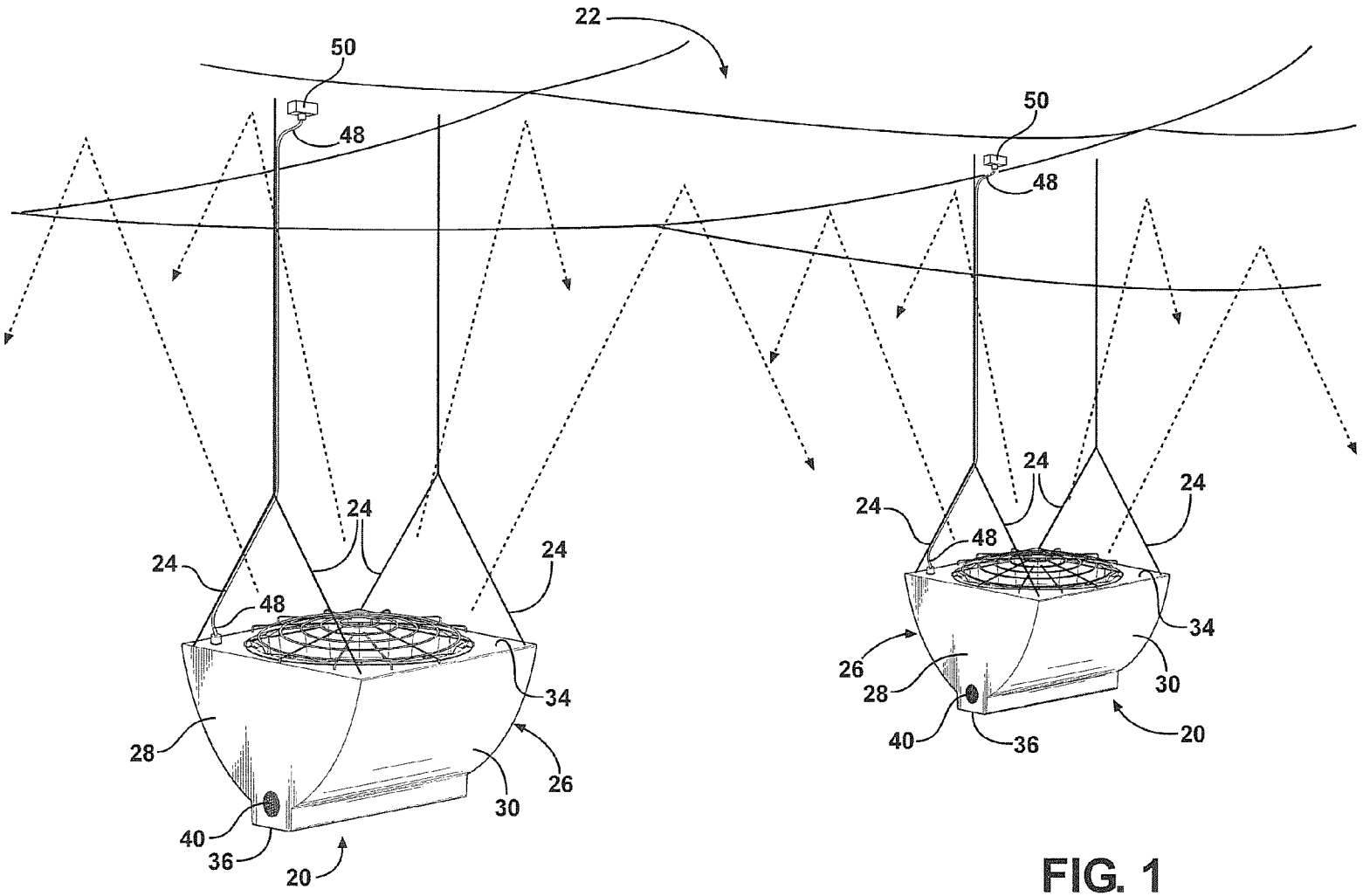
FIG. 1 is an environmental view of a plurality of lighting assemblies, suspended from a ceiling, of the present invention.
Figure 2:
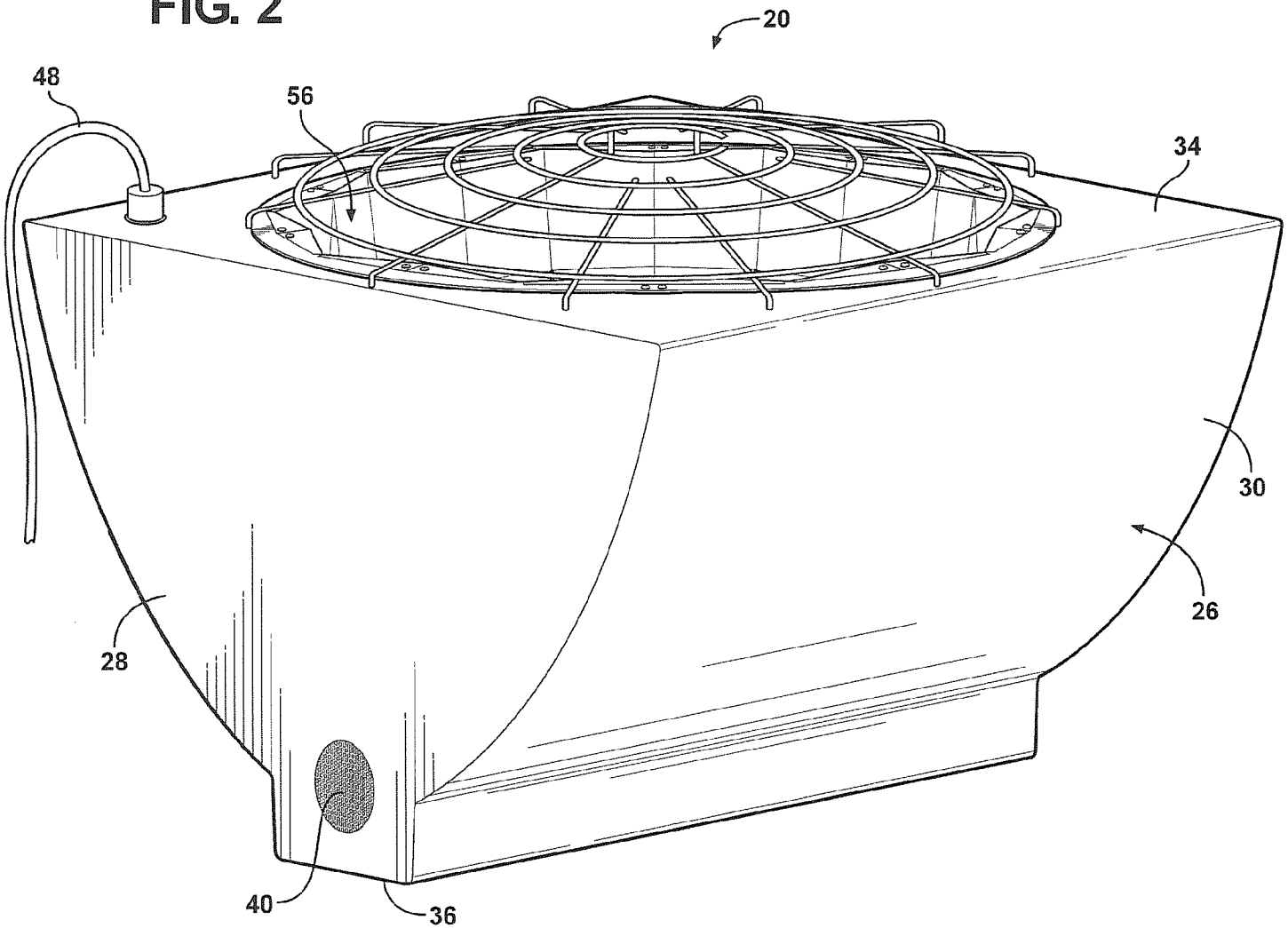
FIG. 2 is a perspective view of a lighting assembly of the present invention.

As best shown in FIG. 1, the lighting assembly 20 provides light for indoor facilities, such as sporting arenas and pool areas. Each lighting assembly 20 is suspended from a ceiling 22 of the indoor facilities and illuminates the ceiling 22 thereby providing indirect light to an area (not shown) below the lighting assembly 20. Hence, such assemblies are typically referred to as indirect-light assemblies. For illustrative purposes, light rays are shown with dashed lines in FIG. 1. Typically, a plurality of cables 24 are used to suspend the lighting assembly 20 from the ceiling 22. However it should be appreciated that any suitable method of coupling the lighting assembly 20 to the ceiling 22 may be employed without deviating from the subject invention.

Referring additionally to FIGS. 2-5, the lighting assembly 20 includes a housing 26. The housing 26 comprises a pair of end walls 28 spaced from and substantially parallel to one another. The housing 26 further includes a pair of side walls 30 disposed between and substantially perpendicular to the end walls 28. The side walls 30 and the end walls 28 define a cavity 32. A top wall 34 and a bottom wall 36 bound the end walls 28 and the side walls 30 and enclose the cavity 32. The top wall 34 defines an aperture 38 for allowing access into the cavity 32. Each of the end walls 28 define at least one vent 40 for allowing air to enter into and exit out of the cavity 32 for ventilating the cavity 32.

Figure 3:
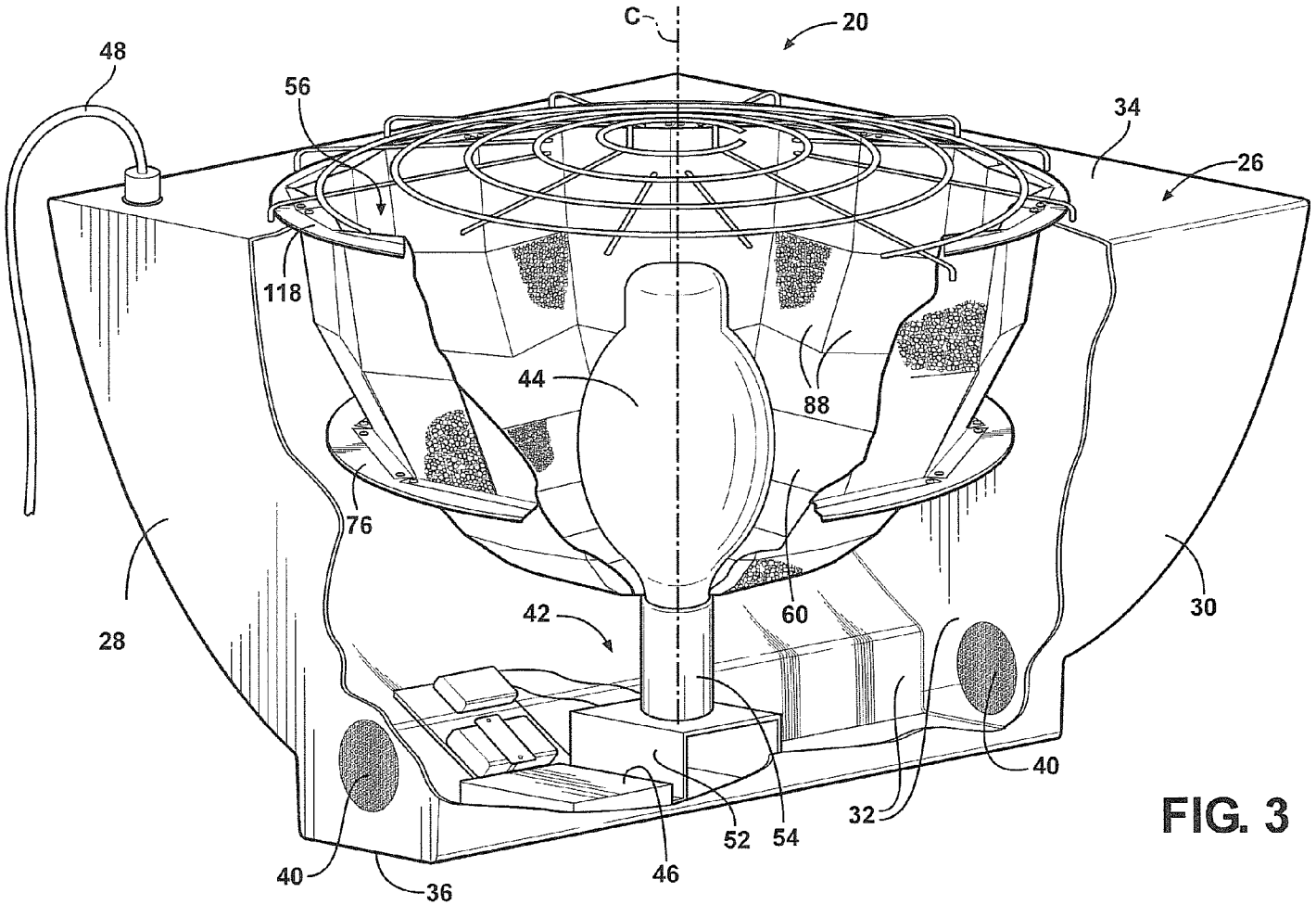
FIG. 3 is a partially cross-sectional perspective view of the lighting assembly.
Figure 4:
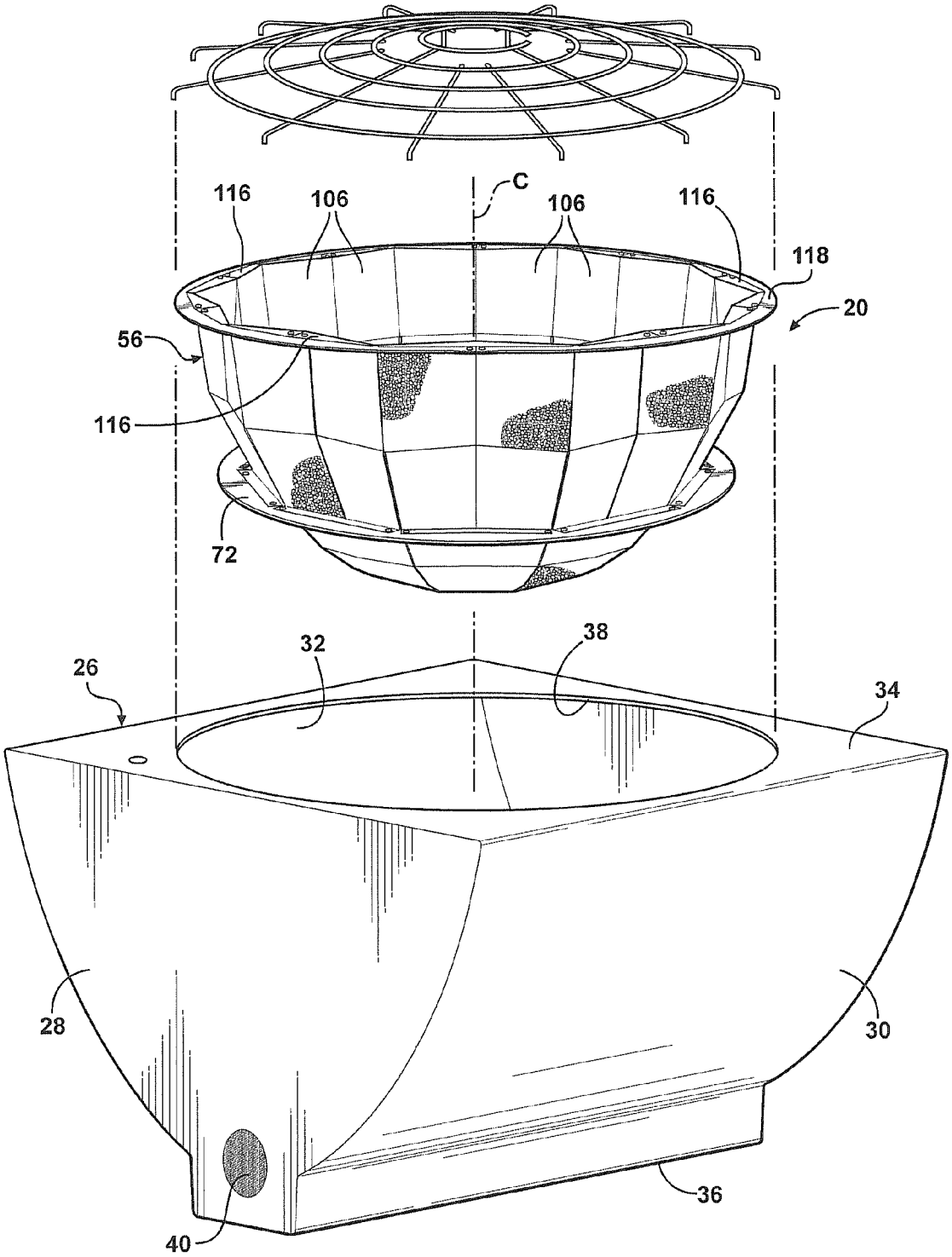
FIG. 4 is a partially exploded view of the lighting assembly.

As best shown in FIG. 3, the lighting assembly 20 includes an electrical system 42 disposed within the cavity 32. The electrical system 42 includes a light source 44 and a ballast 46 coupled to the light source 44 for regulating electricity supplied to the light source 44. In the embodiment shown throughout the Figures, the light source 44 is a metal halide lamp. For such types of lamps, a pulse-start ballast is used. However, it should be appreciated that the other types of light sources may be utilized without deviating from the subject invention, such as high-pressure sodium, mercury vapor, plasma light, light emitting diode (LED), gas-discharge lamp, or any other light source known in the art. Additionally, it should be appreciated that alternative types of ballasts or power supplies or AC/DC converters will be required based on the type of light source chosen and will not deviate from the subject invention. A power cable 48 is disposed through the housing 26 for coupling the electrical system 42 to an electric power source 50 and supplying electricity thereto. Typically the electric power source 50 is a standard electrical outlet. However, any appropriate electric power source 50 may be used, such as those previously performed by electricians.

The prior art lighting assemblies require a ballast assembly, separate from the lighting assembly, to regulate the electricity supplied to the assembly. These additional ballasts as well as the lighting assemblies themselves require an electrician or someone with specialized training to ensure proper installation. This can be costly since most facilities require multiple lighting assemblies. It is an object of the present invention to alleviate some of the costs and time requirements associated with installation by pre-wiring the ballast 46 within the housing 26. An end user of the lighting assembly merely needs to plug the power cable 48 into a standard electrical outlet.

A lamp stand 52 is secured within the cavity 32 and includes a socket 54. The socket 54 accepts the light source 44 and electrically couples the light source 44 to the ballast 46. Any heat generated from the electrical system 42 may be dissipated through the aperture 38. The vents 40 defined by the end walls 28 draw in air to keep the light source 44 cool thereby extending the life of the light source 44.

The lighting assembly 20 further includes a reflective body 56 disposed within the aperture 38 defined by the top wall 34. The light source 44 extends through the reflective body 56 and defines a central axis C. The lamp stand 52 positions the light source 44 relative to the reflective body 56 for directing the light. In the preferred embodiment the metal halide lamp includes an arc tube (not shown) that emits light from the lamp. The location of arc tube relative to the reflective body 56 determines the output from the lighting assembly 20. In practice, the light output from the lighting assembly 20 can vary by up to 40% based on the location of the lamp stand 52. It is to be appreciated that the optimal location of the light source 44 will be dictated by the type of light source 44 used with the lighting assembly 20. The light emitted from the light source 44 is reflected off of the reflective body 56 and uniformly dispersed out of the lighting assembly 20 for providing uniform illumination to an area below the lighting assembly 20. The lighting assembly 20 of the present invention is able to emit up to 93% of the light provided by the light source 44. The reflective body 56 defines a dome-shaped configuration and is secured to the housing 26.

Figure 7:
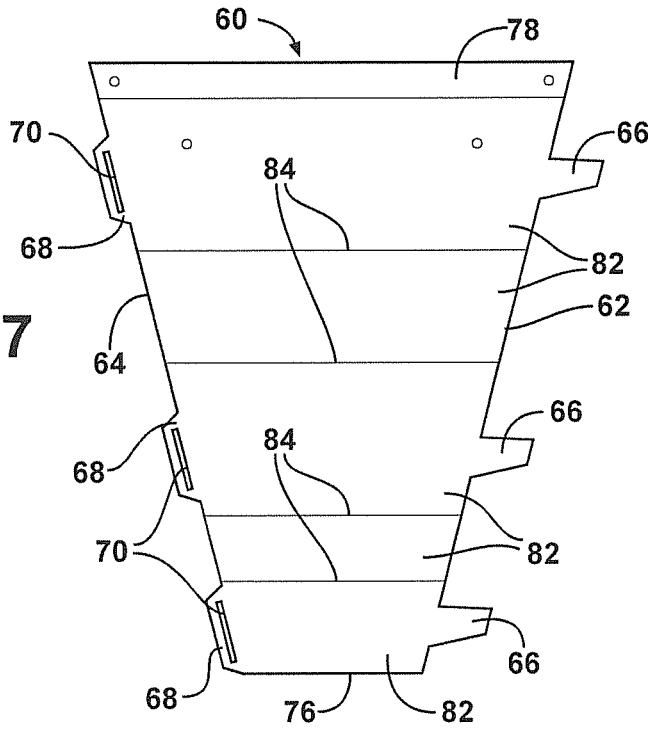
FIG. 7 is planar view of a first reflector.
Figure 9:
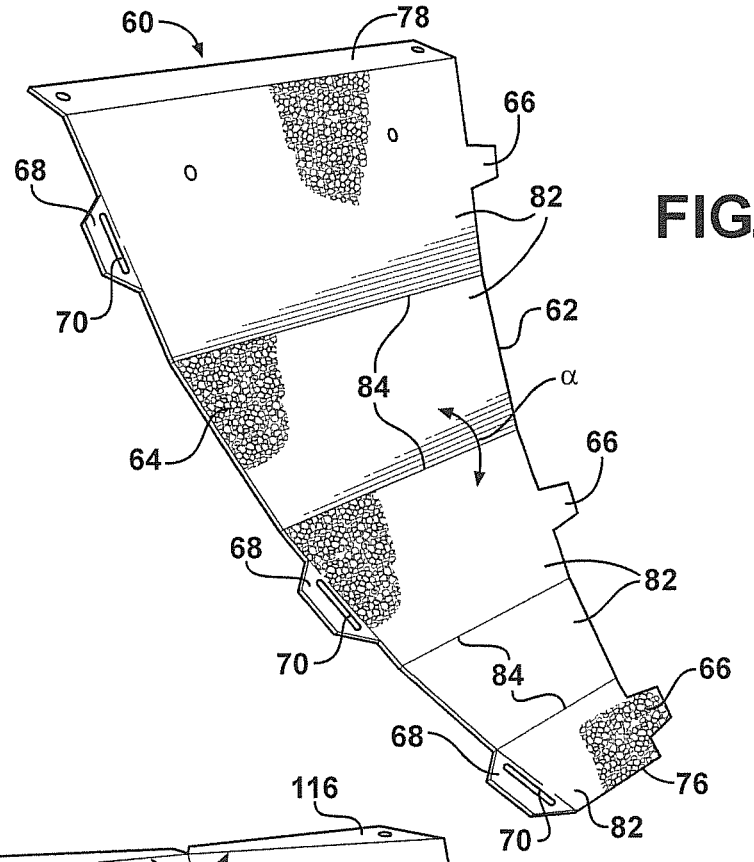
FIG. 9 is a perspective view of the first reflector.
Figure 11:
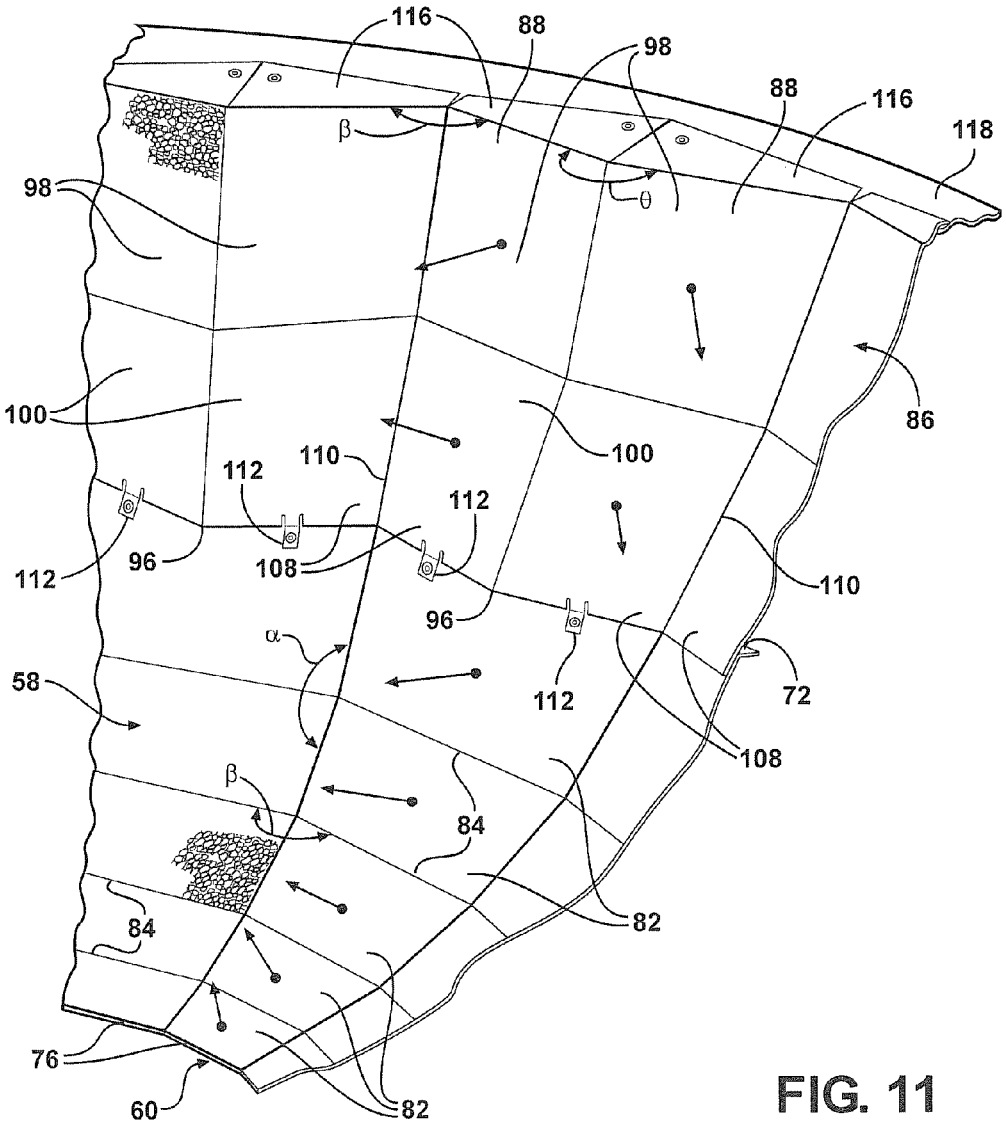
FIG. 11 is a fragmented perspective view of the reflective body.

FIG. 7 shows a first reflector 60 in a planar view prior to being formed. FIG. 9 illustrates the first reflector 60 in a perspective view after the first reflector 60 has been formed. The first reflector 60 includes a first side 62 and a second side 64. A plurality of first attachment elements 66 extend from the first side 62. The first attachment elements 66 are further defined as tabs 66. A plurality of second attachment elements 68 extend from the second side 64 and define a slot 70. The first reflector 60 is further defined as a plurality of first reflectors 60 and will be referred to in the plural form henceforth. Each slot 70 is adapted to accept one of the tabs 66 extending from the next adjacent first reflectors 60 for securing the first reflectors 60 in the first array. Each of the first reflectors 60 are in an obtuse angular relationship with the next adjacent first reflectors 60. The first reflectors 60 form a lower array 58 of the reflective body 56 as best shown in FIG. 11. For illustrative purposes only, this obtuse angular relationship is illustrated as $\beta$. Typically $\beta$ is of from about 110° to about 170°, more typically from about 120° to about 150°. It is to be appreciated that other methods of attaching the first reflectors 60 together in the first array may be employed without deviating from the subject invention.

As best shown in FIG. 6, a lower ring 72 is disposed about the central axis C. The first reflectors 60 further include a first upper end 74 and a lower end 76 spaced from the first upper end 74. A first flange 78 extends from the first upper end 74 for attaching to the lower ring 72 and securing the first reflectors 60 in the lower array 58. When in the lower array 58, the lower end of each of the first reflectors 60 define a hole 80 for allowing the light source 44 to pass through into the reflective body 56.

Each of the first reflectors 60 comprise a plurality of planar surfaces 82 defined by a plurality of horizontal bends 84. Each of the planar surfaces 82 are in an obtuse angular relationship with each of the next adjacent planar surfaces 82. For illustrative purposes only, this obtuse angular relationship is illustrated as $\alpha$ in FIG. 11. It is to be appreciated that the obtuse angular relationship a between each of the planar surfaces 82 may vary along the first reflector 60. Said differently, each of the planar surfaces 82 are at different obtuse angles relative to one another. The obtuse angles between the planar surfaces 82 progressively get steeper moving from the lower end 76 toward the first upper end 74 along each of the first reflectors 60, such that an arcuate configuration is formed, as best shown in FIG. 9. Additionally, each of the planar surfaces 82 increase in size moving from the lower end toward the first upper end.

Referring now to FIGS. 11-13, the reflective body 56 further includes an upper array 86 of second reflectors 88 disposed about the central axis C. The second reflectors 88 are coupled to the first reflectors 60, forming the dome-shaped configuration. Each of the second reflectors 88 include a left face 90 and a right face 92 defining a reflex angle $\theta$ therebetween. Typically $\theta$ is greater than 180°, more typically of from about 181° to about 270°, even more typically from about 181° to about 220°. The reflex angle $\theta$ terminates in a vertex 96 forming a triangular protrusion extending toward the central axis C. The vertex 96 is centrally disposed on planar surface of the first reflectors 60 nearest each of the second reflectors 88. The left face 90 and the right face 92 each include an upper portion 98 and a lower portion 100 and define an obtuse angular relationship between the upper portion 98 and the lower portion 100 of each of the left 90 and right 92 faces such that the upper portion 98 is at a steeper incline than the lower portion 100. For illustrative purposes only, this obtuse angular relationship is illustrated as γ in FIG. 10. Additionally, the upper array 86 defines an obtuse angular relationship between next adjacent second reflectors 88, illustrated as β as described above.

Figure 8:
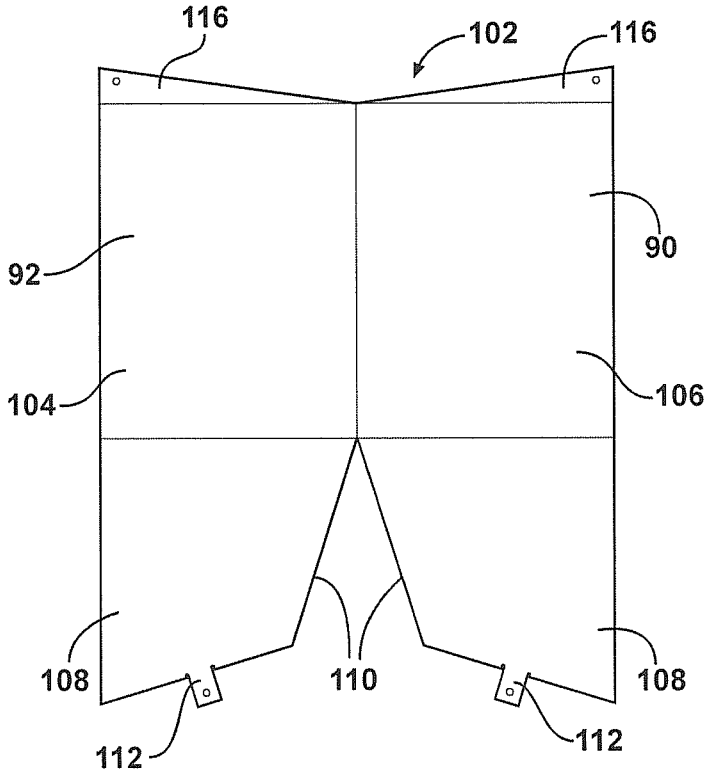
FIG. 8 is a planar view of an upper panel.
Figure 10:
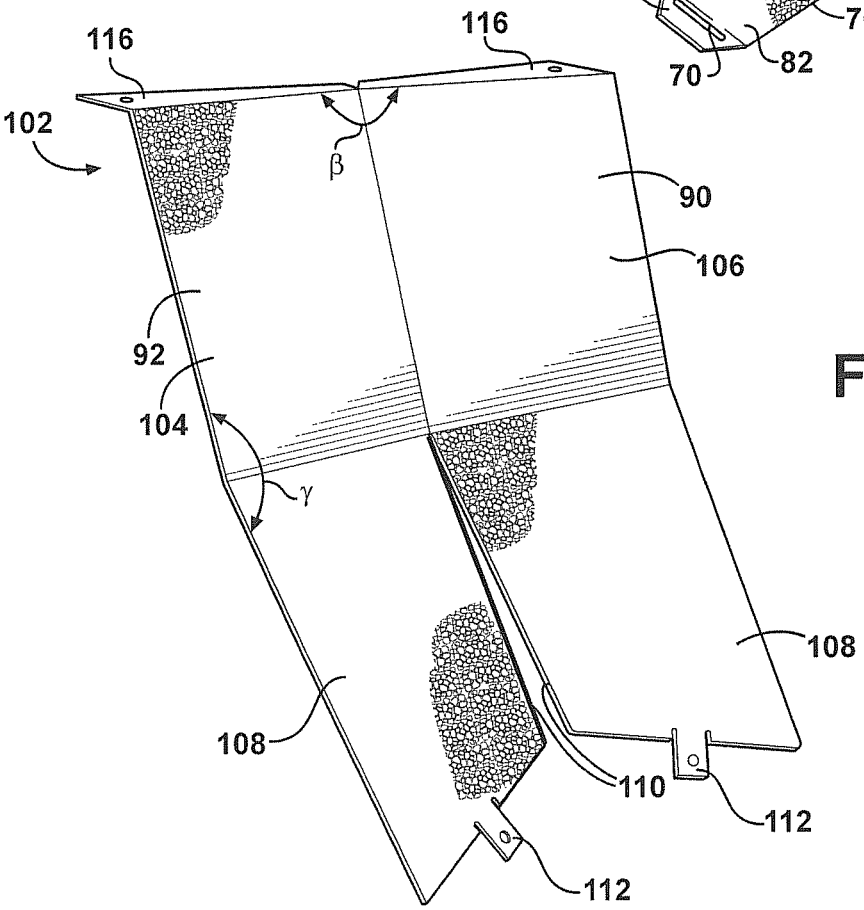
FIG. 10 is a perspective view of the upper panel.

FIG. 8 shows an upper panel 102 in a planar view prior to being formed. FIG. 10 illustrates the upper panel 102 in a perspective view after the upper panel 102 has been formed. The upper panel 102 is further defined as a plurality of upper panels 102 and will be referred to in the plural form henceforth. Each of the second reflectors 88 are formed by a pair of next adjacent upper panels 102. The upper panels 102 include a primary side 104 and a secondary side 106. The primary side 104 forms the right face 92 of one of the second reflectors 88 and the secondary side 106 forms the left face 90 of the next adjacent second reflectors 88. The upper panels 102 include the upper portion 98 of the second reflectors 88 described above. Additionally, the upper panels 102 include a pair of legs 108 extending from the upper portion 98 and define a slit 110 therebetween for allowing the upper panels 102 to bend forming the second reflectors 88. The legs 108 form the lower portion 100 of the second reflectors 88. Each of the legs 108 includes a projection 112 extending therefrom for fastening to the first reflectors 60. Each of the primary side 104 and the secondary side 106 further include a second upper end 114 each having a second flange 116 extending therefrom.

Referring now to FIGS. 6 and 11, an upper ring 118 is disposed about the central axis C and spaced from the lower ring 72. Each second flange 116 attaches to the upper ring 118 for securing the upper panels 102 in the upper array 86. In the preferred embodiment, the slit 110 is aligned with the second side 64 of one of first reflectors 60 and the first side 62 of the next adjacent first reflectors 60, such that one of the legs 108 of the upper panels 102 is coupled to one of the first reflectors 60 and the other one of the legs 108 is coupled to the next adjacent first reflectors 60.

Figure 14:
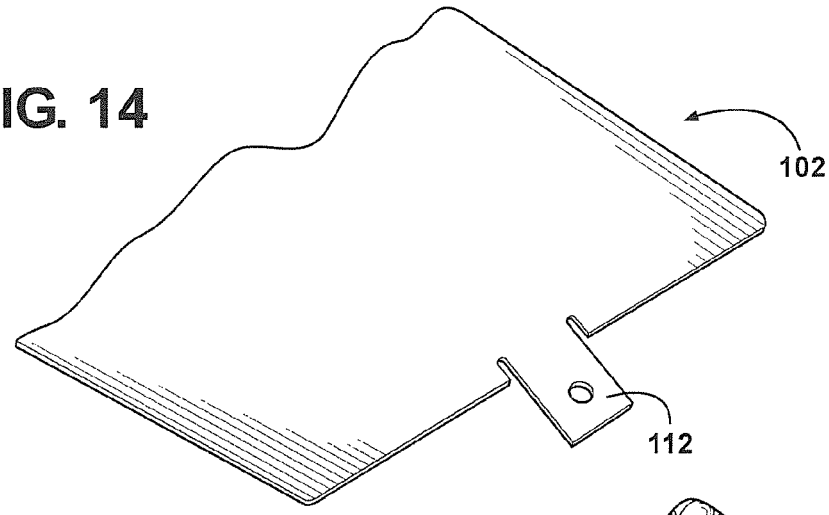
FIG. 14 is a fragmented perspective view of the second reflector illustrating a smooth surface finish.
Figure 15:
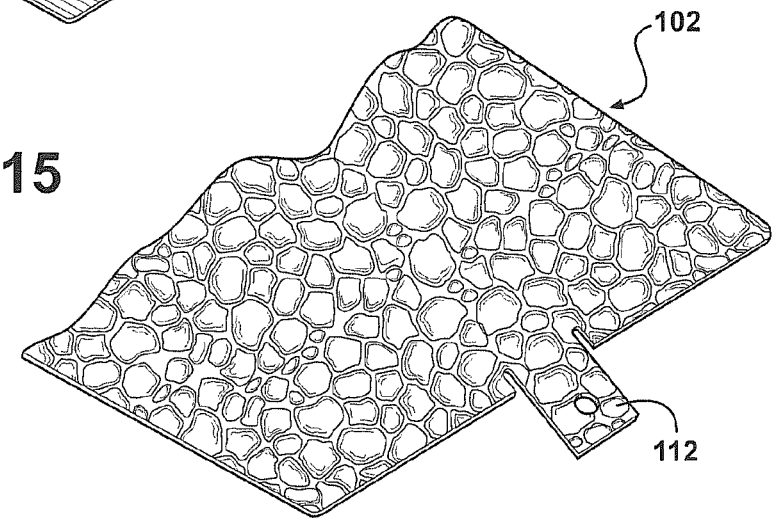
FIG. 15 is a fragmented perspective view of the second reflector illustrating a first surface treatment.
Figure 16:
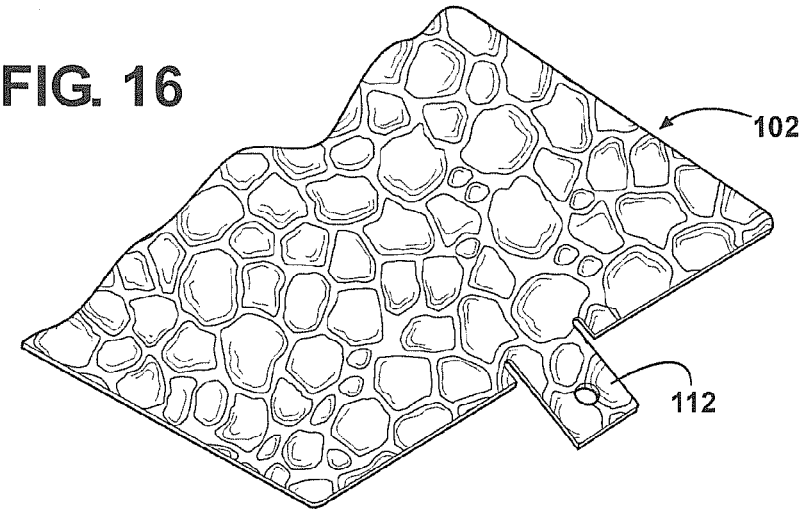
FIG. 16 is a fragmented perspective view of the second reflector illustrating a second surface treatment.

In the primary embodiment the first 60 and second 88 reflectors are typically fabricated from Micro-4® aluminum, manufactured by Alanod®. A variety of finishing treatments may be applied to the surface of the first 60 and second 88 reflectors. Varying sized dimples may be applied to the surface to achieve the desired light output of the lighting assembly 20. This dimpling is commonly referred to as hammertone finishing as illustrated in FIGS. 15 and 16. Typically the dimpling has a diameter of ½ inch or less, more typically ⅜ inch or less, even more typically ¼ inch or less. Alternatively, the surface can be left smooth resulting in a minor-like finish as shown in FIG. 14. The first 60 and second 88 reflectors may have the same type of finishing treatments applied or each may have a different type of finishing treatments depending on the application of the lighting assembly 20. It is to be appreciated that any other appropriate finishing treatments may be applied to the first 60 and second 88 reflectors without deviating from the subject invention.

The present invention has been described in an illustrative manner, and it is to be understood that the terminology which as been used in intended to be in the nature of words of description rather than of limitation. Obviously, many modifications and variations of the present invention are possible in light of the above teachings. The invention may be practiced otherwise than as specifically described within the scope of the appended claims.

What is claimed is:

1. A reflective body for use with a light source to disperse light from the light source, said body comprising:

a lower array comprising a plurality of first reflectors having a lower end and disposed about a central axis and forming a plurality of obtuse angles between next adjacent first reflectors, such that said lower array has a continuous obtuse angular configuration;

an upper array coupled to said lower array comprising a plurality of second reflectors disposed about said central axis; each of said second reflectors comprising a left face and a right face adjacent each other;

said upper array comprising a plurality of obtuse angles defined by next adjacent second reflectors and a plurality of reflex angles defined by said left face and said right face of said second reflectors; and said first reflectors further comprising a plurality of planar surfaces defined by discrete horizontal bends with next adjacent planar surfaces in obtuse angular relationships with one another and said planar surfaces progressively increase in size moving away from said lower end and approaching said second reflectors.

2. The body as set forth in claim 1 wherein said first reflectors form an arcuate configuration for transitioning said first reflectors into said second reflectors.

3. The body as set forth in claim 1 wherein said reflex angles defined by said left face and said right face terminate in a vertex forming a triangular protrusion extending away from said second reflectors with said vertex being centrally positioned on said planar surfaces of said first reflectors nearest said second reflectors.

4. The body as set forth in claim 1 wherein said left face and said right face further include an upper portion and a lower portion, wherein said upper portion and said lower portion are disposed in an obtuse angular relationship.

5. The body as set forth in claim 4 wherein said upper portion is at a steeper incline than said lower portion.

6. The body as set forth in claim 4 wherein said lower portion includes a leg extending from each of said left face and said right face and define a slit therebetween for allowing said legs to be oriented in an obtuse angular relationship with each other.

7. The body as set forth in claim 6 wherein said second reflectors are oriented such that said slit of said second reflector aligns with a first side of one of said first reflectors and also aligns with a second side of next adjacent said first panel.

8. The body as set forth in claim 7 further including a projection extending from each of said legs for attaching said upper reflectors to said lower reflectors.

9. The body as set forth in claim 1 wherein said upper array and said lower array form a dome-shaped structure for uniformly dispersing the light.

10. The body as set forth in claim 1 wherein said first reflectors further include a first upper end and have a first flange extending therefrom coupled to a lower ring for supporting said first reflectors in said lower array.

11. The body as set forth in claim 1 wherein said second reflectors further include a second upper end and have a second flange extending away from each of said left and right faces secured to an upper ring for supporting said second reflectors in said upper array.

12. The body as set forth in claim 1 wherein each of said first reflectors include a first side presenting a plurality of first attachment elements and a second side spaced from said first side and presenting a plurality of second attachment elements.

13. The body as set forth in claim 12 wherein said first attachment elements are further defined as tabs extending from said first side and said second attachment elements define a slot therein for accepting said tabs of next adjacent said first reflectors.

14. A lighting apparatus comprising in combination:

an electrical assembly including a light source for emitting light;

a housing enclosing said electrical assembly; and a reflective body comprising a lower array comprising a plurality of first reflectors having a lower end and disposed about a central axis and forming a plurality of obtuse angles between next adjacent first reflectors such that said lower array has a continuous obtuse angular configuration and an upper array coupled to said lower array and comprising a plurality of second reflectors disposed about said central axis and defining a plurality of obtuse angles between next adjacent second reflectors, each of said second reflectors including a left face and a right face adjacent each other defining a plurality of reflex angles therebetween, said first reflectors further comprising a plurality of planar surfaces defined by discrete horizontal bends with next adjacent planar surfaces in obtuse angular relationships with one another and said planar surfaces progressively increase in size moving away from said lower end and approaching said second reflectors;

said reflective body having a dome-shaped structure disposed about said light source for uniformly distributing light emitting from said light source; and said reflective body directing said light out of said dome-shaped structure for indirectly casting the light to an area below said housing.

* * * * *